US005987791A

United States Patent [19]

Paine

[11] Patent Number: 5,987,791

[45] Date of Patent: Nov. 23, 1999

[54] MOUNTING AND DISPLAY DEVICE FOR CARD-LIKE ITEMS

[76] Inventor: Leslie Paine, 12 Mandela Street, London SW9 6EL, United Kingdom

[21] Appl. No.: 08/537,699

[22] PCT Filed: Apr. 25, 1994

[86] PCT No.: PCT/GB94/00868

§ 371 Date: Oct. 27, 1995

§ 102(e) Date: Oct. 27, 1995

[87] PCT Pub. No.: WO94/25949

PCT Pub. Date: Nov. 10, 1994

[30] Foreign Application Priority Data

Apr. 27, 1993 [GB] United Kingdom ..... 9308644

[51] Int. Cl.[6] ..... A47F 7/00

[52] U.S. Cl. ..... 40/124.4; 40/124.2; 40/657; 24/563

[58] Field of Search ..... 40/641, 652, 657, 40/658, 124.4, 124.2; 24/67.1, 30.5, 563, 67.9; 211/50, 55

[56] References Cited

U.S. PATENT DOCUMENTS

| | | | |
|---|---|---|---|
| D. 138,021 | 6/1944 | Pollak . | |
| 864,648 | 8/1907 | Jaeger | 40/778 X |
| 1,845,843 | 2/1932 | Hutchings | 40/398 |
| 1,888,704 | 11/1932 | Swett | 24/DIG. 9 |
| 2,513,239 | 6/1950 | Hatchett | 40/657 X |
| 2,532,131 | 11/1950 | Vogel . | |
| 2,639,254 | 5/1953 | Smith | 40/705 X |
| 2,842,882 | 7/1958 | Greene et al. | 40/777 X |
| 2,844,900 | 7/1958 | Miller . | |
| 2,935,807 | 5/1960 | Townsend, Jr. et al. | 40/777 |
| 3,810,324 | 5/1974 | Hart . | |
| 4,319,422 | 3/1982 | Robins . | |
| 5,097,961 | 3/1992 | Patino | 211/10 |
| 5,242,062 | 9/1993 | Engravalle | 40/124.4 X |

FOREIGN PATENT DOCUMENTS

| | | |
|---|---|---|
| 367656 | 11/1906 | France . |
| 27472 | of 1906 | United Kingdom . |
| 2129296 | 5/1984 | United Kingdom . |

*Primary Examiner*—Cassandra H. Davis

*Attorney, Agent, or Firm*—Sughrue, Mion, Zinn, Macpeak & Seas, PLLC

[57] ABSTRACT

A mounting device (10), for use in the display of a generally flat item (20), is constituted by sheet material formed with at least one gripping portion (14) which is itself formed with at least one gripping slit (12) which is non-linear, the sheet material preferably being a resilient plastics material formed with a number of the gripping portions (14) each of which is formed with a number of the gripping slits (12).

14 Claims, 3 Drawing Sheets

MOUNTING AND DISPLAY DEVICE FOR CARD-LIKE ITEMS

The present invention relates to a mounting device for use in the display of a generally flat item such as a photograph, postcard or the like.

Conventionally, such items are displayed by being pinned onto a cork surface or being held against a steel surface by a magnet.

An aim of the present invention, however, is to enable the item to be mounted by a device that is in one piece, does not need ancillary items to be effective and does not damage the item to be mounted.

According to the present invention, a mounting device for use in the display of a generally flat item comprises sheet material formed with at least one gripping portion which is itself formed with at least one gripping slit which is non-linear.

The fact that the grippling slit is non-linear facilitates the retention by the gripping slit of an edge region of the item to be held.

The mounting device is preferably constructed such that the sheet material is a resilient material and/or a plastics material and indeed is preferably formed of polypropylene.

Preferably, a plurality of the gripping portions are formed in the sheet material.

Also preferably, each of the gripping portions is formed with a plurality of the gripping slits, with each of the gripping slits being curvilinear or angular, and inner ends of the gripping slits in each of the gripping portions terminating at points close to one another, or at points spaced from one another to form a common hub.

It is possible for the gripping portions to project locally forwardly of the surrounding sheet material, and it is also possible for an adhesive or other fixing to be provided to enable the sheet material to be itself mounted on a support.

Several embodiments of the invention will now be described, by way of example only, with reference to the accompanying drawings in which.

Figure 1:
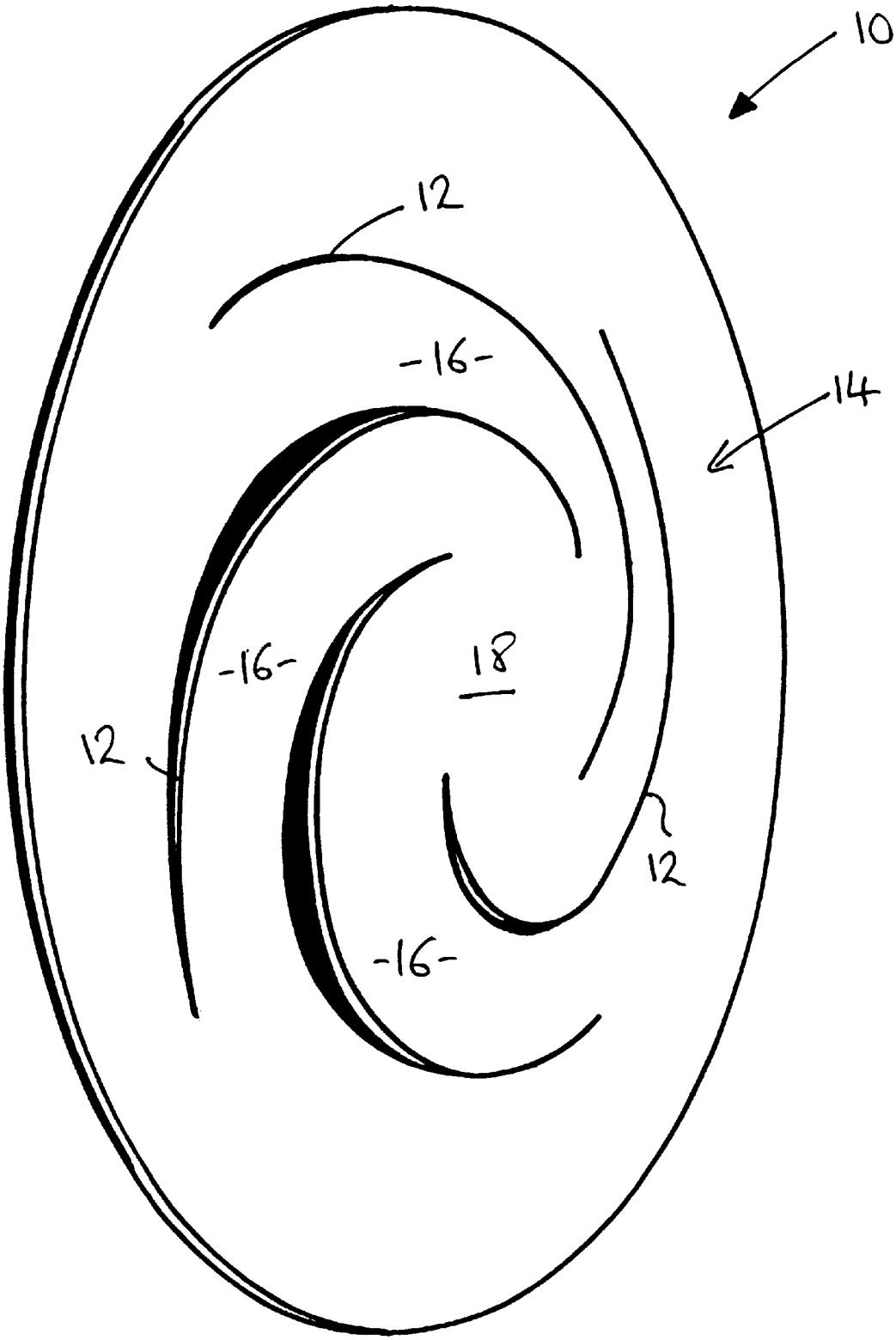
FIG. 1 is a perspective view of a rudimentary mounting device.

A rudimentary mounting device 10, in accordance with the present invention, is shown in FIG. 1. It is created from sheet material which is pierced through by a number of cuts, configured in a cluster, that allow the sheet material to be locally projected forward, creating thin openings that are also locally projected forward. The cuts constitute a plurality of gripping slits 12, and the cluster constitutes a single gripping portion 14.

Figure 2:
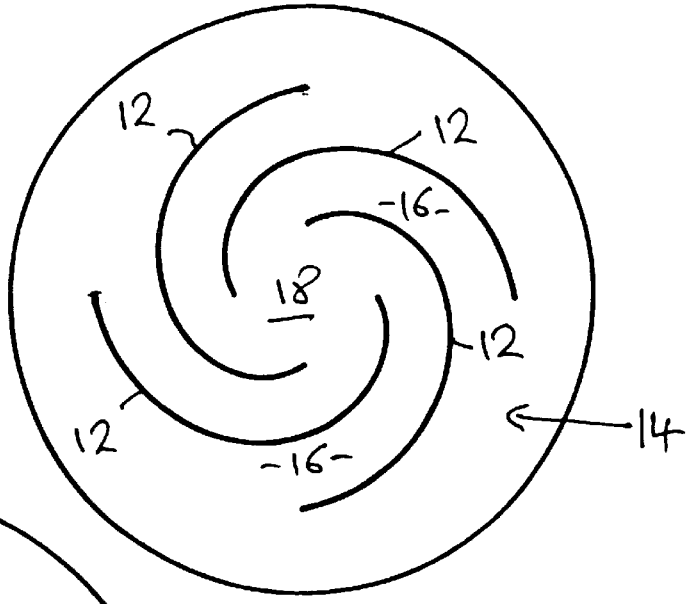
FIG. 2 is a front view of the gripping slit configuration of FIG. 1.

As shown more clearly in FIG. 2, the cuts are configured in such a manner that they create bands 16 of material separated only by the cuts. The outer ends of the bands 16 are always attached to the surrounding sheet material. The inner ends of the bands 16 terminate at points spaced from one another to form a common hub 18.

Figure 3:
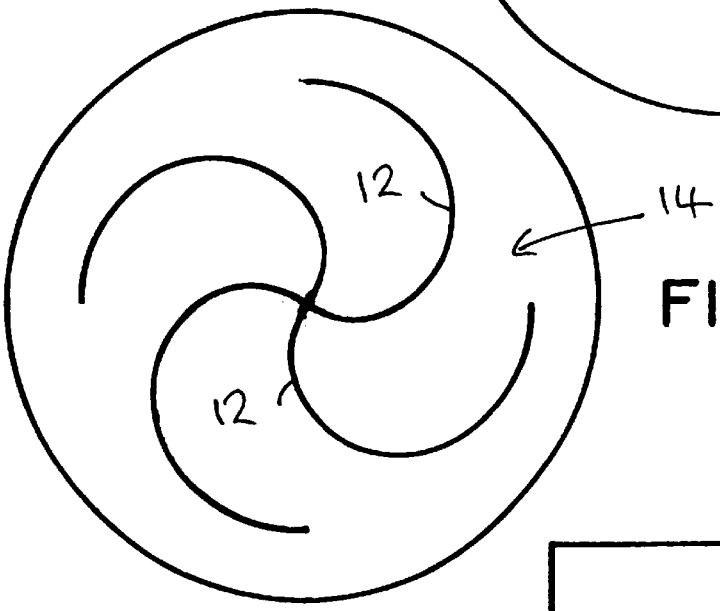
FIG. 3 is a front view of another gripping slit configuration.

Alternatively, as shown in FIG. 3, the cuts may terminate at points close to one another.

Figure 4:
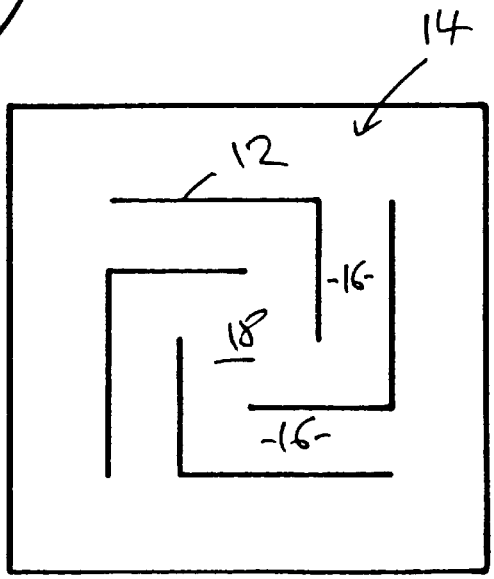
FIG. 4 is a front view of yet another gripping slit configuration.

The shape of each cut can be angular, as shown in FIG. 4, not just curvilinear. The cut will always take a circuitous route from the beginning to the end and specifically not take a single straight line. The number of cuts and subsequent bands can be one or more in number.

The openings can be created either permanently or temporarily by selecting an appropriate sheet material, such as a plastics sheet of which polypropylene is an excellent example, particularly PRIPLAK (RTM). Sprung steel, paper or card may also have a suitable degree of resilience allowing the sheet to spring back to a flat plane or to remain projected forwardly of the surrounding surface. The cuts are configured so that the forming of the openings does not necessarily permanently distort or stretch the sheet material or require the sheet material to lose its ability to return to its original flat plane.

Figure 5:
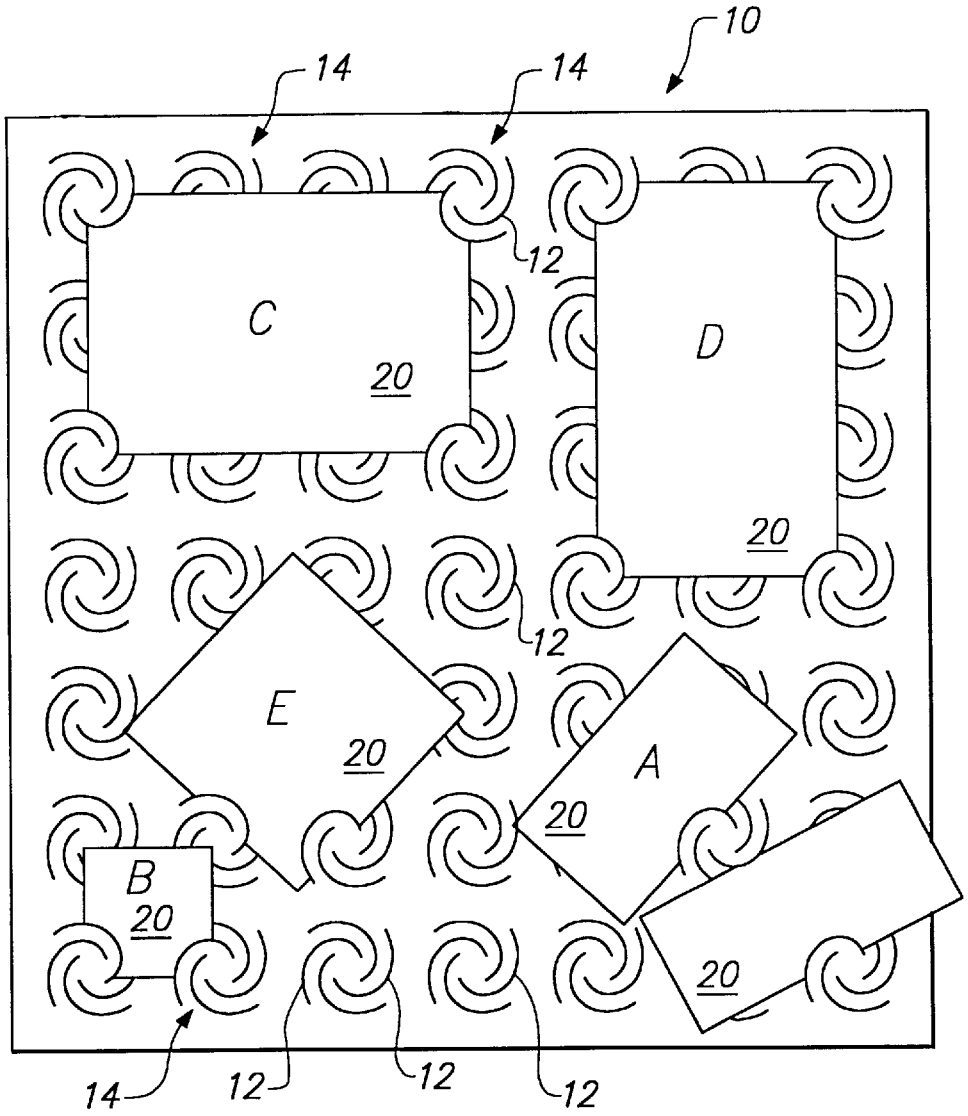
FIG. 5 is a front view of a different mounting device, in use, having a plurality of gripping portions, each having the gripping slit configuration of FIG. 1.

The purpose of the openings is so that a display item 20, such as a postcard, photograph, envelope, Christmas card or other generally flat item can be inserted therein, as shown in FIG. 5.

The mounting of the item 20 to be held is achieved by either jamming the item into the gripping slit 12, creating an interference fit, or the item being clamped as a result of the resilience of the sheet material, or a combination of the two, but the result in all instances is that the item 20 is held securely, closely parallel to the surrounding surface of the sheet material.

In any one gripping portion 14, more than one item 20 can be secured in positions around the cluster of cuts, as indicated at A in FIG. 5.

A number of gripping portions 14 can be arranged in a suitable grid format, so that more than one edge or corner of the item 20 to be held can be entrapped thus varying the degree of hold on the item 20 to be held, as shown at B in FIG. 5.

The grid can be arranged so that items of different proportions and sizes can be displayed formally, either 'Landscape' (horizontally) C, 'Portrait' (vertically) D or 'Casually' (diagonally) E, or a combination of all three.

The cuts should be suitably orientated within the sheet material to optimise the entrapment of the items to be held.

An individual cluster can be deployed by attaching it to another surface, such as the dashboard of a car, by an adhesive or mechanical fixing. Similarly, a mounting device having a plurality of clusters can be fixed to a support, such as a wall, by an adhesive or other fixing such as a series of double-sided sticky tabs 24. Alternatively, a multiple cluster sheet can be part of an album, a loose-leaf, a sheet attached to another surface or form part of a free-standing three-dimensional object.

Figure 6:
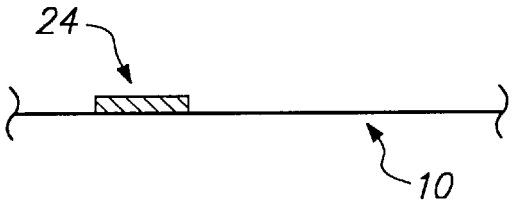
FIG. 6 illustrates a partial cross-section of the invention.

FIG. 6 illustrates a portion of a cross-section of the invention, including one of the adhesive portions.

The mounting device is capable of use with any generally flat item which would usually be formed from a single rigid or semi-rigid flat sheet material which is either transparent or opaque.

I claim:

1. A mounting device, for use in the display of one or more generally flat items, comprises sheet material formed with at least one gripping portion, said at least one gripping portion being formed of a plurality of gripping slits, and said plurality of gripping slits each being formed with first and second ends and a non-linear intermediate portion, wherein said plurality of gripping slits radiate from said first ends generally outwardly to said second ends, such that said first ends are inner ends spaced relatively near to one another and said second ends are outer ends spaced relatively far apart from one another, and wherein said plurality of gripping slits in the same gripping portion are rotationally symmetrical, such that the gripping of different items by the non-linear intermediate portions of different gripping slits is facilitated in the same gripping portion.

2. A mounting device according to claim 1, in which the sheet material is a resilient material.

3. A mounting device according to claim 2, in which the sheet material is a plastics material.

4. A mounting device according to claim 3, in which the plastics material is polypropylene.

5. A mounting device according to claim 1, in which a plurality of the gripping portions are formed in the sheet material, with said plurality of the gripping portions being identical to one another.

6. A mounting device according to claim 5, in which said plurality of the gripping portions are arranged as a regular matrix of parallel rows and columns.

7. A mounting device according to claim 6, in which said plurality of gripping slits includes four gripping slits which are curvilinear and arranged such that the distance between portions of adjacent gripping slits is constant.

8. A mounting device according to claim 1, in which each of the gripping slits is curvilinear.

9. A mounting device according to claim 1, in which each of the gripping slits is angular.

10. A mounting device according to claim 1, further comprises means for mounting the sheet material to a support.

11. A mounting device according to claim 1, in which each of the gripping slits is identical.

12. A mounting device according to claim 1, in which said plurality of gripping slits includes four gripping slits which are curvilinear and arranged such that the distance between portions of adjacent gripping slits is constant.

13. A mounting device according to claim 1, in which the distance between portions of adjacent gripping slits is constant.

14. A mounting device, for use in the display of one or more generally flat items, comprises sheet material formed with at least one gripping portion, said at least one gripping portion being formed of a plurality of gripping slits, and said plurality of gripping slits each being formed with first and second ends and a non-linear intermediate portion, wherein said plurality of gripping slits radiate from said first ends generally outwardly to said second ends, such that said first ends are inner ends spaced relatively near to one another and said second ends are outer ends spaced relatively far apart from one another, and wherein said plurality of gripping slits are arranged so as not to intersect each other as they radiate generally outwardly, so that a distance between portions of adjacent ones of said plurality of gripping slits is constant, and such that the gripping of different items by the non-linear intermediate portions of different gripping slits is facilitated in the same gripping portion.

* * * * *